United States Patent [19]

MacLean et al.

[11] Patent Number: 4,902,405

[45] Date of Patent: Feb. 20, 1990

[54] FIXED BED HYDROCRACKING PROCESS

[75] Inventors: Alison J. MacLean; Richard L. Holloway; Valerie A. Lawson, all of Bellingham; John W. Cronen, Ferndale, all of Wash.

[73] Assignee: Atlantic Richfield Company, Los Angeles, Calif.

[21] Appl. No.: 297,160

[22] Filed: Jan. 13, 1988

[51] Int. Cl.[4] ..... C10G 65/12

[52] U.S. Cl. ..... 208/59; 208/89; 208/92; 208/95; 208/100

[58] Field of Search ..... 208/59, 92, 94, 95, 208/108

[56] References Cited

U.S. PATENT DOCUMENTS

| | | | |
|---|---|---|---|
| 3,385,781 | 5/1968 | Hamner et al. | 208/59 |
| 3,637,483 | 1/1972 | Carey | 208/92 |
| 3,891,539 | 6/1975 | Nelson et al. | 208/59 |
| 4,404,088 | 9/1983 | Bachtel et al. | 208/111 |

*Primary Examiner*—Anthony McFarlane
*Attorney, Agent, or Firm*—F. Lindsey Scott

[57] ABSTRACT

A process for converting a gas oil range petroleum feedstock into lighter petroleum products by:

(a) charging the gas oil range petroleum feedstock and hydrogen to a first fixed bed hydrocracking zone containing a hydrocracking catalyst at hydrocracking conditions to produce a first hydrocracking zone product stream;

(b) separating the first fixed bed hydrocracking zone product stream in a fractionation zone into a petroleum products stream and a bottoms stream;

(c) charging the bottoms stream and hydrogen to a second fixed bed hydrocracking zone containing a hydrocracking catalyst at hydrocracking conditions to produce a second fixed bed hydrocracking zone product stream;

(d) cooling the second fixed bed hydrocracking zone product stream to a temperature below about 250° F.;

(e) recycling a first portion of the cooled second fixed bed hydrocracking zone product stream to the fractionation zone; removing materials having a boiling range from about 500° to about 650° F. and a heavy bottoms stream having an initial boiling point above about 1050° F. from a second portion of the cooled second fixed bed hydrocracking zone product stream to produce a treated second portion; and (g) recycling the treated second portion to a fixed bed hydrocracking zone.

16 Claims, 3 Drawing Sheets

FIXED BED HYDROCRACKING PROCESS

BACKGROUND OF THE INVENTION

1. Field of the Invention

This invention relates to the conversion of gas oil range petroleum feedstocks into lighter petroleum products by hydrogenation and hydrocracking of such feedstocks in fixed bed catalytic processes.

The present invention also relates to an improvement in such processes whereby substantially all the gas oil range petroleum feedstock fed to the process can be converted to such lighter products.

2. Description of the Prior Art

Fixed bed hydrocracking processes are used in the petroleum industry to convert gas oil range petroleum feedstocks into lighter petroleum products. Such processes perform a function similar to that performed by fluid catalytic cracking processes. The process selected to convert the gas oil range petroleum feedstocks into lighter petroleum products will vary according to a number of factors such as the desired product mix from the process, the type feedstock available for the process and the like. Such considerations are well known to those skilled in the art.

A typical fixed bed catalytic hydrogenation process is shown in FIG. 1 and will be discussed in greater detail hereinafter. In general, such processes comprise charging the gas oil range petroleum feedstock to one or more fixed bed hydrocracking zones containing a hydrocrackin catalyst at hydrocracking conditions to produce a first hydrocracking zone product stream. This product stream is typically charged to a fractionation zone where it is separated into a product stream which is recovered and passed to further processing to produce a variety of products such as gasoline, kerosene, jet fuel, diesel fuel and the like and a bottoms stream which is passed to a second fixed bed hydrocracking zone which contains a hydrocracking catalyst at hydrocracking conditions to produce a second hydrocracking zone product stream. The second hydrocracking zone product stream is then passed to cooling and charged to a fractionating zone which may be the same fractionating zone used to fractionate the product stream from the first hydrocracking zone. The separation of products in the fractionating zone is as discussed previously. It is necessary to cool the product stream from the second hydrocracking zone to a temperature suitable for fractionation and in typical processes of this type quantities of heavy materials accumulate in the bottoms stream from the second hydrocracking zone as a result of the recycling of the bottoms stream from the fractionating zone to the second hydrocracking zone and eventually accumulate in amounts large enough that the heavy materials precipitate in the cooling zone. Previously, such heavy materials have been eliminated by withdrawing a portion of the product stream from the second hydrocracking zone and shipping it to a refinery with a fluid catalytic cracking unit for processing or the like. The portion of the second hydrocracking zone product stream withdrawn is fixed by the amount of heavy material which must be removed to prevent precipitation of the heavy material in the cooling zone. Such remedies for this problem result in a reduction in the amount of lighter, more valuable hydrocarbon products recovered from the process and in considerable expense when the material removed is shipped to another refinery for additional processing. Accordingly, a continuing effort has been directed to the development of a process whereby substantially all the gas oil petroleum feedstocks charged to fixed bed hydrocracking processes can be converted to lighter, more valuable petroleum products in the process.

SUMMARY OF THE INVENTION

According to the present invention it has been found that substantially all the gas oil range petroleum feedstock charged to a fixed bed hydrocracking process can be converted to lighter petroleum products by a process consisting essentially of A. charging the gas oil range petroleum feedstock and hydrogen to a first hydrocracking zone containing a hydrocracking catalyst at hydrocracking conditions to produce a first hydrocracking zone product stream;

B. separating the first hydrocracking zone product stream in a fractionating zone into a petroleum products stream and a fractionating zone bottoms stream;

C. charging the fractionating zone bottoms stream and hydrogen to second fixed bed hydrocracking zone containing a hydrocracking catalyst at hydrocracking conditions to produce a second hydrocracking zone product stream;

D. cooling the second fixed bed hydrocracking zone product stream to a temperature below about 250° F.;

E. recycling a first portion of the cooled second fixed bed hydrocracking zone product stream to the fractionating zone;

F. removing a heavy bottoms stream having a boiling point at atmospheric pressure above about 1050° F. from a second portion of the cooled second fixed bed hydrocracking zone product stream to produce a treated second portion; and G. recycling the treated second portion to a fixed bed hydrocracking zone.

DESCRIPTION OF THE PREFERRED EMBODIMENTS

In the discussion of the Figures the same numbers will be used throughout to refer to the same or similar components, flow lines and the like. Further, various heat exchangers, compressors, pumps and the like necessary to accomplish the desired flows have not been shown. All boiling ranges and boiling temperatures are stated for the particular streams at atmospheric pressure unless otherwise stated.

Figure 1:
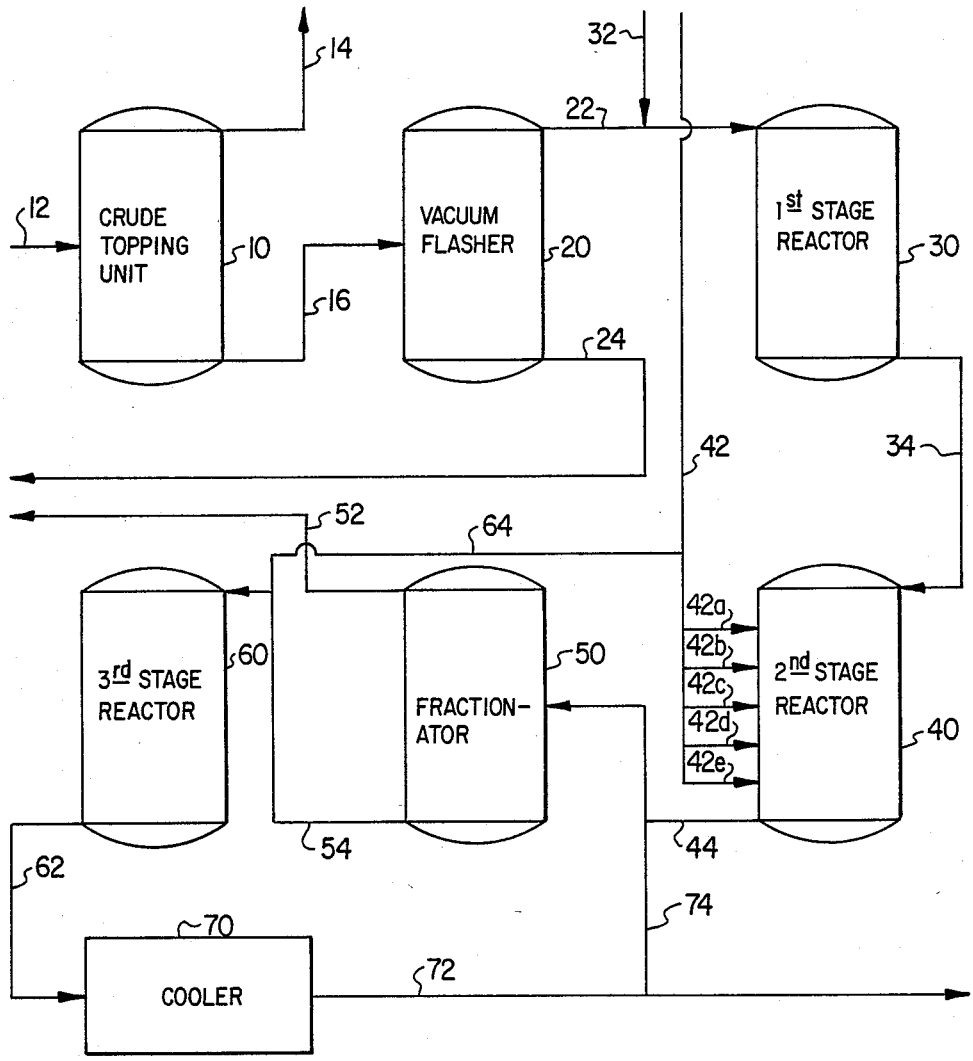
FIG. 1 (PRIOR ART)
FIG. 1 is a general process flow sheet showing a prior art fixed bed hydrocracking process for the conversion of crude oil into lighter petroleum products.

In FIG. 1, crude oil feedstock is charged to a crude oil topping unit 10 through a line 12. Lighter petroleum products generally having a boiling range below about 500° F. are recovered from topping unit 10 through a line 14 and passed to further processing to produce a variety of petroleum products such as gasoline, kerosene, jet fuel, diesel fuel and the like. As well known to those skilled in the art, topping unit 10 can comprise one or a plurality of vessels. The bottoms stream recovered from topping unit 10 is recovered through a line 16 and passed to a vacuum flasher 20. In vacuum flasher 20, an overhead stream is recovered through a line 22 and comprises a gas oil range petroleum feedstock. A bottoms stream is recovered from vacuum flasher 20 through a line 24 and passed to further processing. Heavy petroleum fractions such as the bottoms stream in line 24 can be charged to an asphalt plant to produce asphalt products of various grades or to a petroleum coking plant for the production of additional light petroleum products and petroleum coke. Such uses for heavy petroleum streams are considered to be well known to those skilled in the art and form no part of the present invention.

As shown in FIG. 1, the gas oil range petroleum feedstock recovered through line 22 is passed to a fixed bed hydrotreating zone, shown as a first stage reactor 30 and then to a first hydrocracking zone shown as a second stage reactor 40. While no desulfurization unit has been shown, it is known that the use of a desulfurization unit may be necessary between vacuum flasher 20 and the fixed bed hydrocracking zone with some crude oil feedstocks. The gas oil stream in line 22 is charged to first stage reactor 30 in combination with hydrogen supplied through a line 32 and reacted in first stage reactor 30 to produce a first reactor product stream recovered through a line 34 and passed to second stage reactor 40. In second stage reactor 40, hydrogen is added through a line 42 and a plurality of lines **42*a*, 42*b*, 42*c*, 42*d*, and 42*e* at various levels of second stage reactor 40. It is well known to those skilled in the art to add hydrogen to such reactors by a variety of techniques to effectively achieve the desired hydrocracking reactions in each reactor. Such variations are considered to be known to those skilled in the art. The reactor product from second stage reactor 40 is recovered through a line 44 and passed to fractionation in a fractionator 50. First stage reactor 30 and second stage reactor 40 as shown operate at substantially the same conditions. A suitable hydrotreating catalyst for use in first stage reactor 30 comprises nickel and molybdenum supported on a silica alumina base. Typically such catalysts contain about 2 weight percent nickel and about 6 weight percent molybdenum. Such catalysts are considered to be known to those skilled in the art and are commercially available. One such catalyst is HCH catalyst, available from Criterion Catalyst Company, 1100 East Business Center Drive, Mount Prospect, Ill. 60056-7614. Reaction conditions in first stage reactor 30 and second stage reactor 40 are a total pressure from about 1700 to about 1900 pounds per square inch absolute (psia), a hydrogen partial pressure from about 1550 to about 1700 (psia), a temperature from about 700 to about 800° F., and a residence time from about 5 to about 10 minutes. Typical conditions are a total pressure of about 1800° psia, a hydrogen partial pressure of about 1625 psia, a temperature of about 750° F. and a residence time of about 7 minutes. As well known to those skilled in the art, these conditions will vary within the ranges stated depending upon the particular feedstock charged to the reactors, the condition of the catalyst beds in the reactors and the like. Suitable catalysts for use in reactor 40 are set forth below in conjunction with the discussion of catalysts for use in reactor 60. In the process shown desulfurization, denitrogenation and olefin hydrogenation are accomplished in the hydrotreating process in reactor 30**. It should be understood that although the first fixed bed hydrocracking zone has been shown as a single reactor, a plurality of reactors could be used.

The product stream from second stage reactor 40 is ducts stream which is recovered through a line 52 and passed to further processing for the production of valuable petroleum products such as gasoline, kerosene, jet fuel, diesel oil and the like. Fractionator 50 may comprise one or a plurality of units, may be used to achieve substantially any desired separation and may remove products as heavy as diesel oil and, optionally, even heavier products although a frequent separation is the recovery of products lighter than diesel fuel. The bottoms stream recovered from fractionator 50 is passed through a line 54 to combination with hydrogen supplied through a line 64 and the resulting mixture is charged to a second fixed bed hydrocracking zone shown as a third stage reactor 60. Reactor 60 comprises a fixed bed catalytic hydrocracking zone where the bottoms stream from fractionator 60 is further converted into lighter petroleum products. A suitable catalyst for use in reactor 40 and in reactor 60 comprises nickel and molybdenum supported on a zeolite base. Such catalysts typically contain from about 6.0 to about 7.0 weight percent nickel and from about 9.0 to about 11.0 percent molybdenum. Such catalysts are considered to be known to those skilled in the art and are commercially available. One such catalyst is HC-14 catalyst available from Universal Oil Products, Inc., 12399 Lewis Street, Suite 201, Garden Grove, Calif. 92640. Reaction conditions in reactor 60 are a total pressure from about 1700 to about 1900 psia, a hydrogen pressure from about 1550 to about 1700 psia, a temperature from about 500 to about 650° F. and a residence time from about 5 to about 10 minutes. Typical conditions in reactor 60 are a total pressure of about 1800 psia, a hydrogen partial pressure of about 1625 psia, a temperature of about 500° to about 600° F. and a residence time of about 7 minutes. It is well known to those skilled in the art that such typical reaction conditions will vary within the ranges discussed previously dependent upon the particular feedstock to reactor 60, the condition of the catalyst in reactor 60 and the like. While the second hydrocracking zone has been shown as a single vessel, it should be understood that a plurality of reactors could be used.

The product stream from reactor 60 is recovered through a line 62 and passed to a cooler 70 where it is cooled by any suitable means to a temperature suitable for charging to fractionator 50, typically to a temperature below about 250° F. and usually from about 150 to about 250° F. The cooled product stream is recovered through a line 72 and at least a portion of the recovered stream is passed through a line 74 to fractionator 50 for treatment as discussed in connection with the reactor product stream from reactor 40.

In the practice of processes of this type it has been found that when all of the product stream from reactor 60 is recycled to fractionator 50 to process all the gas oil stream charged to the first stage hydrocracking process to complete conversion to lighter products heavy materials accumulate in the stream in line 62 until the heavy materials begin to precipitate in cooler 70. This precipitation, if allowed to continue, results in plugging the cooling equipment and shutting down the process. To eliminate this problem, a portion of the cooled product stream recovered through line 72 sufficient to reduce the amount of heavy material in line 72 to an amount such that no, or insignificant, precipitation occurs in cooler 70 has been withdrawn and passed to treatment in a refinery having a fluid catalytic cracking process, or otherwise removed from the hydrocracking process. The removal of this portion of a valuable stream is detrimental to process efficiency and results in the sale of desirable products as a lower value feedstream to a fluid catalytic cracking process. In either case, an economic disadvantage is incurred.

According to the present invention it has been found that when materials boiling in a range from about 500° F. to about 650° F. and materials having a boiling range above about 1050° F. are removed from the cooled stream recovered through line 72, the remaining components of the cooled stream can be recycled to extinction (i.e. to complete conversion to lighter petroleum products) in the process with a resulting gain in the amount of valuable petroleum products produced from the process. It is believed that the materials boiling in a range from about 500 to about 650° F. contain the precursor materials for the heavy materials having a boiling range above about 1050° F. which ultimately form in the recycled stream. By removal of the stream boiling from about 500° to about 650° F., it is believed that the precursor materials for the heavy materials are removed and by removal of the precursor materials, the amount of heavy material ultimately formed can be reduced. By reducing the amount of heavy material formed and by removing heavy materials from a portion of the stream in line 72 the heavy materials can be maintained at a level which permits continuous recycle of the cooled product stream to extinction.

Figure 2:
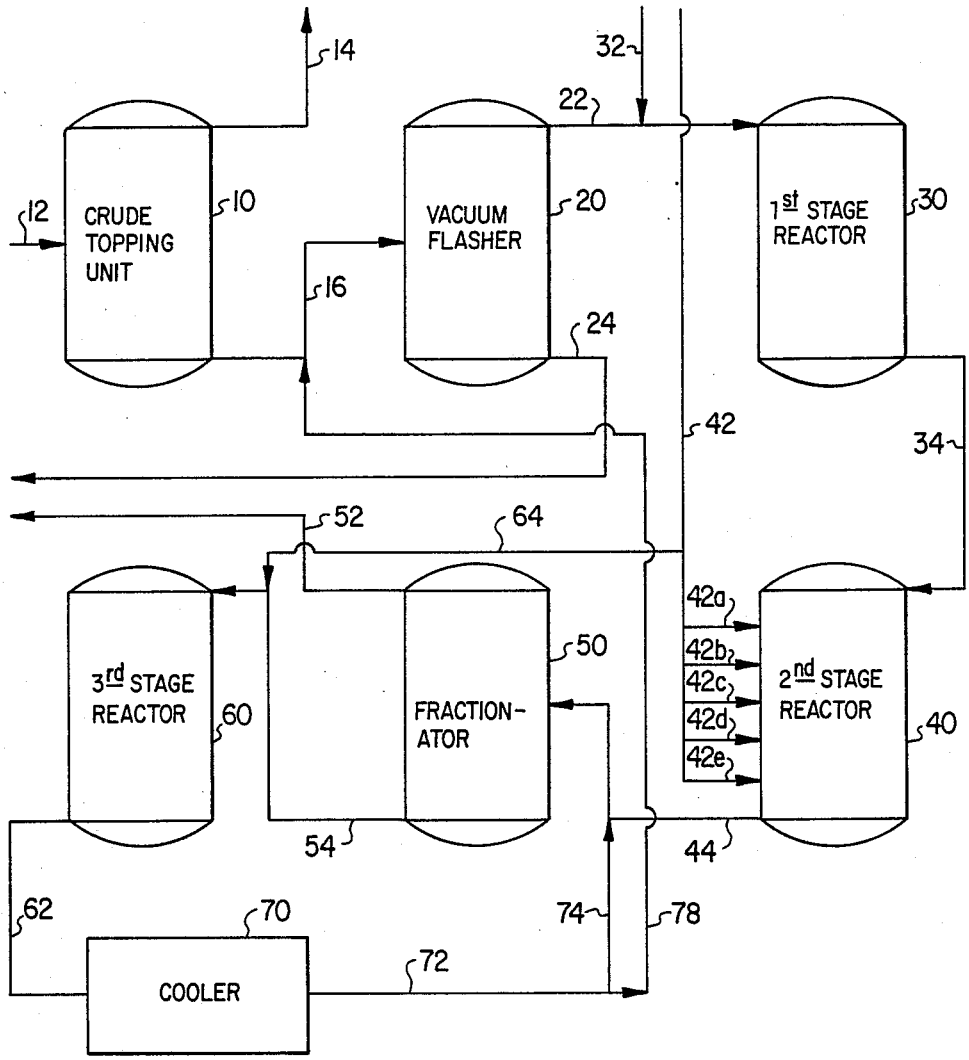
FIG. 2 is a general process diagram of an embodiment of the present invention.

According to the process shown in FIG. 2 the removal of the materials boiling in a range from about 500° to about 650° F. and materials having a boiling range above about 1050° F. is accomplished by recycling a portion of the cooled product stream recovered through line 72 through a line 78 to vacuum flasher 20. Vacuum flashers are generally operated to produce a gas oil stream having a boiling range from about 650° to about 1050° F. When the stream in line 78 is treated in vacuum flasher 20, materials having a boiling range above about 1050° F. are recovered with the bottoms stream recovered line 24 from vacuum flasher 20. These materials are effectively eliminated from the process and passed to an alternate processing which may result in the production of additional light petroleum products. The amount of material having a boiling range above 1050° F. is not large but can constitute a severe problem when allowed to precipitate in cooler 70. In the embodiment shown in FIG. 2, fractionator 50 is desirably operated to separate materials having a boiling range above about 650° F. from the stream charged to fractionator 50. Operation of the fractionator in this manner effectively removes the precursor materials for the formation of the heavy materials having a boiling range above about 1050°F. from the fractionator bottoms stream in line 54 (i.e. the charge stream to reactor 60).

Figure 3:
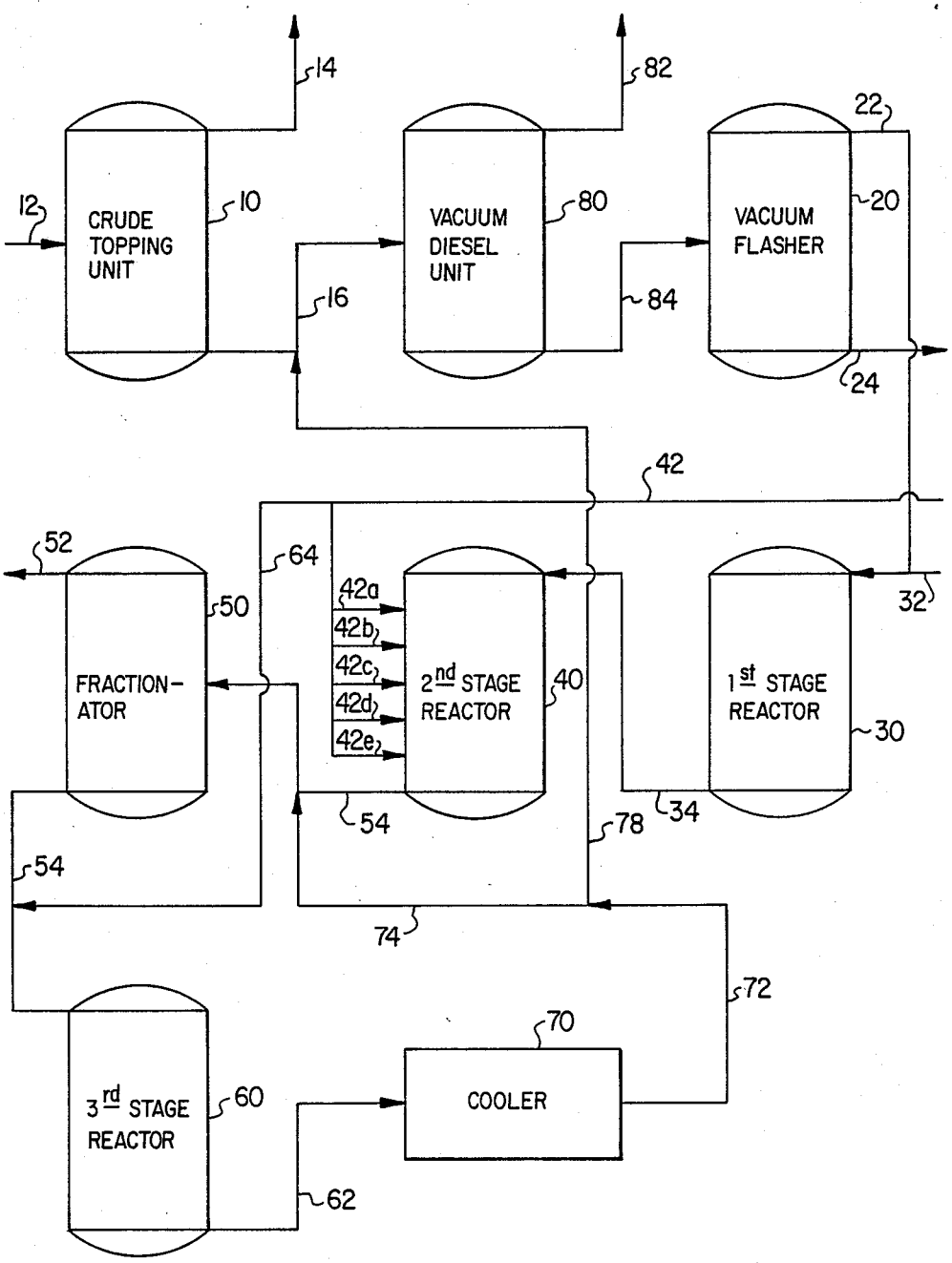
FIG. 3 is a general process diagram of an alternate embodiment of the process of the present invention.

In FIG. 3 an alternate embodiment is shown wherein a vacuum diesel unit 80 is used to separate a diesel fuel stream having a boiling from about 500° to about 650°F. from the bottom stream from crude topping unit 10 prior to charging the bottoms stream to vacuum flasher 20. The bottoms stream recovered via a line 84 from vacuum diesel unit 80 constitutes the charge to vacuum flasher 20 which is operated to produce a gas oil stream having a boiling range from about 650° to about 1050° F. A diesel product stream having a boiling range from about 500° to about 650° F. is recovered through a line 82. In this embodiment, fractionator 50 may be operated to produce a product stream in line 52 having a boiling point below about 500° F. In vacuum diesel unit 80 the fraction of the cooled product stream passed to further treatment through line 78 is subjected to the removal of the materials boiling in a range from about 500° to about 650° F. thus removing the precursors for the heavy materials boiling above about 1050° F. In vacuum flasher 20 the heavy materials having a boiling range above about 1050° F. are removed. Both of these product streams are typically subjected to further processing to produce valuable products and by the use of the improvements discussed aove, substantially all the gas oil range petroleum feedstock charged to the fixed bed hydrocracking process is converted into valuable hydrocarbon products. By use of the improvement of the present invention it has been found that the conversion of the gas oil to valuable products is increased from about 98 weight percent to about 99.5 weight percent. Similarly the volume percent yield is increased from about 121.5 volume percent to about 123 volume percent. Even more significantly the yield of liquid light products has been increased from 91 percent to 92 percent based upon the volume of gas oil charged to the process.

While similar results could be accomplished by the use of any suitable processing equipment to treat a portion of the cooled product stream in line 72 to remove materials having a boiling range between about 500° and about 650°F. and heavy materials having a boiling range above 1050° F. it is believed that the use of existing process equipment as shown in FIGS. 2 and 3 has resulted in a synergistic process improvement without the need for additional processing equipment. Not only has a process limiting problem been resolved, but the materials removed have been effectively converted into desirable products with a net increase in product yield of valuable products.

The portion of the cooled product stream passed to vacuum flasher 20 or vacuum diesel unit 80 for treatment to remove the materials boiling from about 500° to about 650° F. and the heavy materials boiling above about 1050° F. is an amount sufficient to lower the amounts of recirculating heavy material in the stream recycled to fractionator 50 through line 74 to a level below which substantially no heavy material precipitates in cooler 70. If necessary all of the stream in line 72 can be passed to treatment, but usuallytreatment of from about 5 to about 10 percent of the stream results in a suitable reduction in the amount of recirculating heavy material.

Having thus described the invention by reference to its preferred embodiments, it is respectfully pointed out that the embodiments described are illustrative rather than limiting in nature and that many variations and modifications are possible within the scope of the present invention. Many such variations and modifications may appear obvious and desirable to those skilled in the art based upon a review of the foregoing description of preferred embodiments.

Having thus described the invention, I claim:

1. A process for converting a gas oil range petroleum feedstock into lighter petroleum products, said process consisting essentially of:

(a) charging said gas oil range petroleum feedstock and hydrogen to a first fixed bed hydrocracking zone containing a hydrocracking catalyst at hydrocracking conditions to produce a first hydrocracking zone product stream;

(b) separating said first fixed bed hydrocracking zone product stream in a fractionation zone into a petroleum products stream and a bottoms stream;

(c) charging said bottoms stream and hydrogen to a second fixed bed hydrocracking zone containing a hydrocracking catalyst at hydrocracking conditions to produce a second fixed bed hydrocracking zone product stream;

(d) cooling said second fixed bed hydrocracking zone product stream to a temperature below about 250° F.;

(e) recycling a first portion of said cooled second fixed bed hydrocracking zone product stream to said fractionation zone;

(f) removing materials having a boiling range from about 500° to about 650° F. and a heavy bottoms stream having a boiling point above about 1050° F. from a second portion of said cooled second fixed bed hydrocracking zone product stream to product a treated second portion; and (g) recycling said treated second portion to said first fixed bed hydrocracking zone.

2. The process of claim 1 wherein said gas oil range petroleum feedstock is produced by:

(a) treating a crude oil stream in a crude oil topping zone to produce a light petroleum fraction and a crude oil topping zone bottoms stream; and (b) separating said crude oil topping zone bottoms stream in a vacuum flashing zone into said gas oil range petroleum feedstock and a vacuum flashing zone bottoms stream.

3. The process of claim 2 wherein said vacuum flashing zone comprises a gas oil flashing zone and a diesel flashing zone wherein a diesel fuel fraction is separated from said crude oil topping zone bottoms stream prior to charging said crude oil topping zone bottoms stream to said gas oil flashing zone.

4. The process of claim 1 wherein said gas oil range petroleum feedstock has a boiling range above about 650° F.

5. The process of claim 1 wherein said hydrocracking catalyst in said first hydrocracking zone consists essentially of nickel and molybdenum supported on a zeolite base.

6. The process of claim 5 wherein said hydrocracking conditions in said first hydrocracking zone comprise a total pressure from about 1700 to about 1900 psia, a hydrogen pressure from about 1550 to about 1700 psia, a temperature from about 700° to about 800° F. and a reaction time from about 5 to about 10 minutes.

7. The process of claim 1 wherein said petroleum products stream separated in said fractionating zone has a boiling range below about 500° F.

8. The process of claim 7 wherein at least a major portion of the petroleum products having a boiling range from about 500° to about 650° F. is separated from said second portion of said cooled second hydrocracking zone product stream prior to recycling said second portion to said first hydrocracking zone.

9. The process of claim 7 wherein said gas oil range petroleum feedstock has a boiling range above about 650° F.

10. The process of claim 5 wherein said first hydrocracking zone comprises a plurality of hydrocracking zones.

11. The process of claim 1 wherein hydrocracking catalyst in said second hydrocracking zone consists essentially of nickel and molybdenum supported on a zeolite base.

12. The process of claim 11 wherein said hydrocracking conditions in said second hydrocracking zone consist essentially of a total pressure from about 1700 to about 1900 psia, a hydrogen pressure from about 1550 to about 1700 psia, a temperature from about 500° to about 650° F. and a reaction time from about 5 to about 10 minutes.

13. A process for converting a gas oil range petroleum feedstock into lighter petroleum products, said process consisting essentially of:

(a) charging said gas oil range petroleum feedstock and hydrogen to a first fixed bed hydrocracking zone containing a hydrocracking catalyst at hydrocracking conditions to produce a first hydrocracking zone product stream;

(b) separating said first fixed bed hydrocracking zone product stream in a fractionation zone into a petroleum products stream having a boiling range below about 650° F. and a bottoms stream having a boiling range above about 650° F.;

(c) charging said bottoms stream and hydrogen to a second fixed bed hydrocracking zone containing a hydrocracking catalyst at hydrocracking conditions to produce a second fixed bed hydrocracking zone products stream;

(d) cooling said second fixed bed hydrocracking zone product stream to a temperature from about 150° to about 250° F.;

(e) recycling a first portion of said cooled second fixed bed hydrocracking zone product stream to said fractionation zone;

(f) removing a heavy bottoms stream having a boiling point at above about 1050° F. from a second portion of said cooled second fixed bed hydrocracking zone product stream to produce a treated second portion; and (g) recycling said treated second portion to said first fixed bed hydrocracking zone.

14. A process for converting a gas oil range petroleum feedstock into lighter petroleum products, said process consisting essentially of:

(a) charging said gas oil range petroleum feedstock and hydrogen to a first fixed bed hydrocracking zone containing a hydrocracking catalyst at hydrocracking conditions to produce a first hydrocracking zone product stream;

(b) separating said first fixed bed hydrocracking zone product stream in a fractionation zone into a petroleum products stream having a boiling range below about 500° F. and a bottoms stream having a boiling range above about 500° F.;

(c) charging said bottoms stream and hydrogen to a second fixed bed hydrocracking zone containing a hydrocracking catalyst at hydrocracking conditions to produce a second fixed bed hydrocracking zone product stream;

(d) cooling said second fixed bed hydrocracking zone product stream to a temperature from about 150° to about 250° F.;

(e) recycling a first portion of said cooled second fixed bed hydrocracking zone product stream to said fractionation zone;

(f) removing materials having a boiling range from about 500° to about 650° F. and a heavy bottoms stream having an initial boiling point above about 1050° F. from a second portion of said cooled second fixed bed hydrocracking zone product stream to produce a treated second portion; and (g) recycling said treated second portion to said first fixed bed hydrocracking zone.

15. The process of claim 14 wherein said gas oil range petroleum feedstock is produced by:

(a) treating a crude oil stream in a crude oil topping zone to produce a light petroleum fraction and a crude oil topping zone bottoms stream; and (b) separating said crude oil topping zone bottoms stream in a vacuum flashing zone into said gas oil range petroleum feedstock and a vacuum flashing zone bottoms stream.

16. The process of claim 15 wherein said vacuum flashing zone comprises a gas oil flashing zone and a diesel flashing zone wherein a diesel fuel fraction is separated from said crude oil topping zone bottoms stream prior to charging said crude oil topping zone bottoms stream to said gas oil flashing zone.

* * * * *